US009550305B2

(12) United States Patent
Caputo

(10) Patent No.: US 9,550,305 B2
(45) Date of Patent: Jan. 24, 2017

(54) BAKERY CUTTING GUIDE

(76) Inventor: Mary L. Caputo, Anaheim, CA (US)

( * ) Notice: Subject to any disclaimer, the term of this patent is extended or adjusted under 35 U.S.C. 154(b) by 508 days.

(21) Appl. No.: 12/725,368

(22) Filed: Mar. 16, 2010

(65) Prior Publication Data

US 2011/0226109 A1 Sep. 22, 2011

(51) Int. Cl.

| | |
|---|---|
| ***B26D 3/24*** | (2006.01) |
| ***B26B 29/06*** | (2006.01) |
| ***B26D 7/00*** | (2006.01) |
| *B26D 1/04* | (2006.01) |

(52) U.S. Cl.

CPC ..... *B26D 3/24* (2013.01); *B26B 29/063* (2013.01); *B26D 7/0006* (2013.01); *B26D 1/04* (2013.01); *Y10T 83/7633* (2015.04); *Y10T 83/8878* (2015.04)

(58) Field of Classification Search

CPC . A21C 15/04; B26B 29/063; B26B 2029/066; B26D 7/0006; B26D 3/24; B62B 2205/02; A47B 3/08

USPC ..... 83/258, 430, 438, 441.1, 442, 444–446,83/452, 613, 644, 635, 743, 932, 821, 468.5,83/35; 269/109–111, 60, 16, 55, 71, 37, 136, 269/138, 46, 81, 289, 292, 901, 316–317; 108/115–135, 147.22, 148; 312/258; 248/149, 150, 154, 155.2, 155.5, 157, 163, 248/164, 432, 173, 176.3, 323, 161, 528, 439, 248/166, 188.1, 163.1, 431, 169, 171; 99/430, 99/537, DIG. 15; 211/85.4, 88.01; 144/253.91; 33/1 F, 3.2, 2, 485, 489, 562, 566

See application file for complete search history.

(56) References Cited

U.S. PATENT DOCUMENTS

| | | | | |
|---|---|---|---|---|
| 892,552 | A | 7/1908 | Rexer | |
| 955,140 | A * | 4/1910 | cronk | 126/30 |
| 1,097,367 | A | 5/1914 | Sabin | |
| 1,827,062 | A | 10/1931 | Austin | |
| 1,895,290 | A * | 1/1933 | Lobel | A47B 3/02 108/120 |
| 2,136,552 | A | 11/1938 | Le Page | |
| 2,371,234 | A | 3/1945 | Fay et al. | |
| 2,434,566 | A | 1/1948 | Hulsmann | |
| 2,487,234 | A | 11/1949 | Gore | |
| 2,570,060 | A | 10/1951 | Johnson | |
| 2,580,263 | A * | 12/1951 | Wooten | 33/32.2 |
| 2,598,789 | A | 6/1952 | Harrell | |
| 2,633,644 | A * | 4/1953 | May | 33/574 |
| 2,652,299 | A * | 9/1953 | Bryan | 108/118 |
| 2,675,286 | A * | 4/1954 | Derman | A47B 3/02 108/119 |
| 2,699,815 | A * | 1/1955 | Vanderminden | 297/39 |
| 2,730,801 | A | 1/1956 | Deedman et al. | |
| 2,760,286 | A * | 8/1956 | Voigt et al. | 108/117 |
| 2,831,741 | A * | 4/1958 | Wilson | 108/169 |
| 2,845,244 | A * | 7/1958 | Prokop | 248/171 |
| 2,873,543 | A * | 2/1959 | Lantz | 108/117 |
| 2,982,824 | A * | 5/1961 | Forrest | H01H 3/40 200/11 D |
| 3,069,719 | A * | 12/1962 | Ridge | 16/30 |
| 3,075,565 | A | 1/1963 | Weaver et al. | |

(Continued)

FOREIGN PATENT DOCUMENTS

| | | |
|---|---|---|
| GB | 2 339 478 A | 1/2000 |
| WO | WO 85/02988 A1 | 7/1985 |

*Primary Examiner* — Stephen Choi
*Assistant Examiner* — Fernando Ayala
(74) *Attorney, Agent, or Firm* — Hackler Daghighian Martino & Novak

(57) ABSTRACT

A bakery cutting guide includes a rim for surrounding baked goods with a plurality of spaced apart pins extending upwardly from the rim. A bar is provided and postionable for engaging pairs of opposing pins for guiding a knife or scorer across the baked goods in order to cut or mark the baked (Continued)

goods in a selected geometric pattern and a plurality of legs extend downwardly from the rim for supporting the rim in an elevated position above a top of the baked goods.

20 Claims, 2 Drawing Sheets

(56) References Cited

U.S. PATENT DOCUMENTS

| | | | | | |
|---|---|---|---|---|---|
| 3,094,948 | A | * | 6/1963 | Clow | 108/10 |
| 3,132,678 | A | | 5/1964 | Steketee | |
| 3,229,735 | A | * | 1/1966 | Parmelee | 83/438 |
| 3,664,028 | A | * | 5/1972 | Smith | 33/430 |
| 3,685,824 | A | * | 8/1972 | Quinn | 482/17 |
| 3,727,508 | A | | 4/1973 | Haapala | |
| 3,777,616 | A | * | 12/1973 | Mueller | 409/109 |
| 3,800,372 | A | | 4/1974 | Daoust | |
| 4,032,103 | A | * | 6/1977 | Ehrichs | D06F 81/04 248/421 |
| 4,133,360 | A | * | 1/1979 | Sanfilippo et al. | 144/286.1 |
| 4,167,815 | A | * | 9/1979 | Jones | 33/430 |
| 4,353,140 | A | * | 10/1982 | Graber | 5/505.1 |
| 4,416,040 | A | | 11/1983 | Towsley | |
| 4,478,397 | A | * | 10/1984 | Krueger | 269/170 |
| 4,648,300 | A | | 3/1987 | Hassenfelt, Jr. | |
| 4,676,005 | A | * | 6/1987 | Seligman | 33/533 |
| 4,683,836 | A | * | 8/1987 | West | 118/305 |
| 4,939,968 | A | | 7/1990 | Stoof | |
| D316,655 | S | | 5/1991 | Buday | |
| 5,036,740 | A | | 8/1991 | Tsai | |
| 5,201,264 | A | | 4/1993 | Thelen et al. | |
| 5,269,212 | A | | 12/1993 | Peters et al. | |
| 6,009,786 | A | | 1/2000 | Hjelden | |
| 6,145,801 | A | * | 11/2000 | Herring, Jr. | 248/463 |
| 6,182,549 | B1 | | 2/2001 | Albright et al. | |
| 6,182,935 | B1 | * | 2/2001 | Talesky | 248/436 |
| 6,719,250 | B2 | * | 4/2004 | FitzSimons | 248/166 |
| 6,745,660 | B2 | | 6/2004 | Caputo | |
| 6,951,342 | B2 | * | 10/2005 | Lan | 280/47.4 |
| 7,849,789 | B1 | * | 12/2010 | Whelan | 99/537 |
| 7,921,785 | B1 | * | 4/2011 | Shin | 108/132 |
| 7,975,396 | B2 | * | 7/2011 | Mastroianni | 33/566 |
| 7,987,604 | B2 | * | 8/2011 | Zernec | 33/32.2 |
| 2004/0182381 | A1 | * | 9/2004 | Yeh | 126/25 R |
| 2007/0029844 | A1 | * | 2/2007 | Lin | A47C 4/24 297/16.1 |
| 2008/0271649 | A1 | * | 11/2008 | Leng | 108/119 |

* cited by examiner

BAKERY CUTTING GUIDE

The present invention is directed to guides for the cutting or scoring of items that can be cut after being baked in a sheet-like form.

More particularly, the present invention provides for a guide for cutting or scoring sheets of cakes or other confections in order that individual servings of the cake or confection are divided into equal portions of uniform size with straight finished edges.

Many confections are traditionally baked in a flat pan with relatively thin cross section. Heretofore, manual use of a knife or roller cutter has been used to cut the confection into individual servings and also remove them from the pan.

Such cutting resulted in slanted or crooked edges and unequal size which degraded the presentation of the finished confection. Further, accurate cutting of the cake by hand is a very time consuming and frustrating process. This is particularly important for professional bakers who must insure that the final produce is acceptable to the purchaser.

Often, such confections must be cut subsequent to their removal from a pan and accordingly it is desirable to provide a cutting guide suitable for cutting the confection in the pan and out of pan, the confections being of various sizes and heights.

SUMMARY OF THE MENTION

A bakery cutting guide in accordance with the present invention generally includes a rim for surrounding baked goods. A plurality of spaced apart pins extend upwardly from the rim and a bar is provided which is positionable for engaging pairs of opposing pins across the pan for guiding a knife or score across the baked goods in order to cut or mark the baked goods in a selected geometric pattern. This geometric pattern may be of any shape, for example, but not limited to a rectangular, triangular, or diamond shape.

A plurality of legs are provided which may extend, or be extendable, downwardly from the rim for supporting the rim in an elevated position above atop of the baked goods. Which is suitable for out-of-pan cutting of baked goods.

More particularly, the legs may be adjustable in order to vary the elevation of the rim above the baked goods and preferably the legs may be foldable.

The rim may be square or rectangular and include a depending flange for engaging a perimeter of a cake pan with the legs being folded to a position of enabling such engagement. Still more particularly, the guide may include form of the plurality of pins disposed at corners of the rim with the remainder of the plurality of pins being evenly disposed between the rim corners.

BRIEF DESCRIPTION OF THE DRAWINGS

The advantages and features of the present invention will be better understood by the following description when considered in conjunction with the accompanying drawings in which:

FIG. 4 is a partial side view illustrating legs in a closed position enabling placement of the rim on top of a pan, or the like;

DETAILED DESCRIPTION

Figure 1:
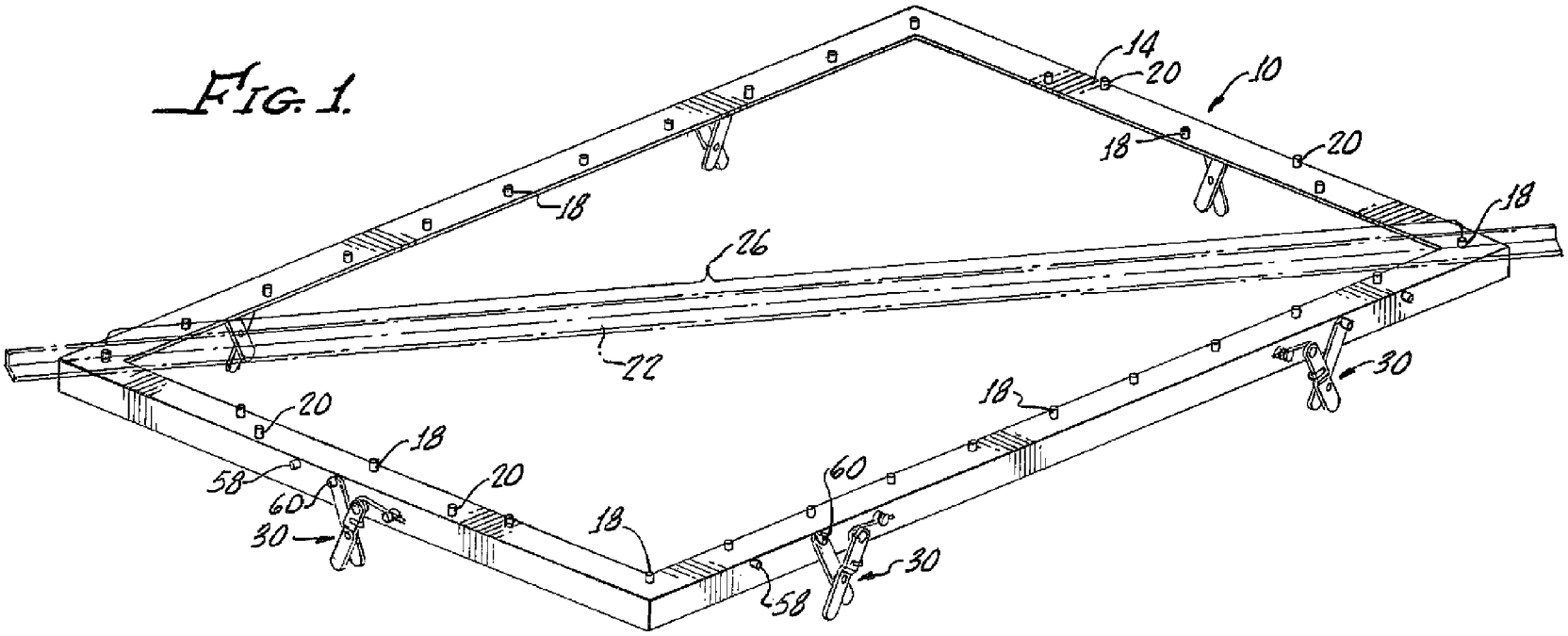
FIG. 1 is a perspective view of a bakery cutting guide in accordance with the present invention generally showing a rim along with a plurality of spaced apart pins extending upwardly from the rim and a bar for engaging opposite pins for guiding a knife or scorer along with a plurality of legs extending downwardly from the rim for supporting the rim in an elevated position above a top of baked goods, not shown in FIG. 1.
Figure 2:
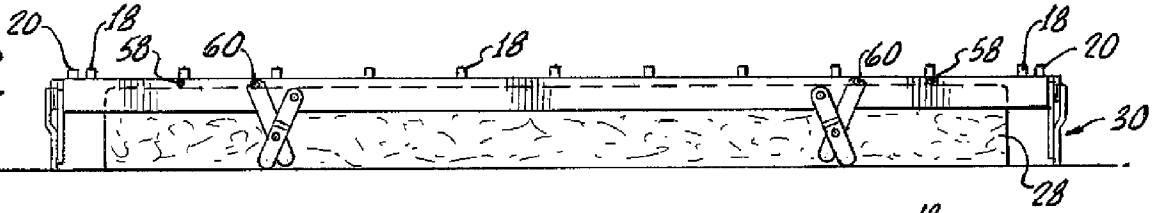
FIG. 2 is a side view of the guide shown in FIG. 1 with the legs in an extended position for supporting the rim above a cake.
Figure 3:
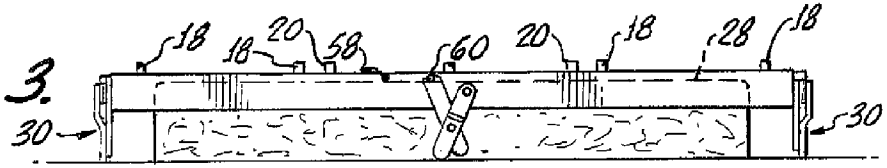
FIG. 3 is an end view of a guide with the legs extended.

With reference to FIGS. 1-3, there is shown a baking cutting guide 10 which includes a rim 14 including a plurality of spaced apart pins 18 extending upwardly from the rim 14. A bar 22 is positionable for engaging pairs 26 of opposing pins 18 for guiding a knife or scorer (not shown) across bake goods 28 in order to cut or mark the baked goods in a selected geometric pattern. Secondary pins 20 may be provided to enable a greater variety of geometric patterns. A plurality of legs 30 extendable downwardly from the rim 14 are provided for supporting the rim 14 in an elevated position above bakery goods of different heights, see FIGS. 4-7.

All of the elements of the present invention may be formed from any suitable materials such as metal or plastic and the rim 14 may be of a rectangular shape, or square, or circular.

Figure 4:
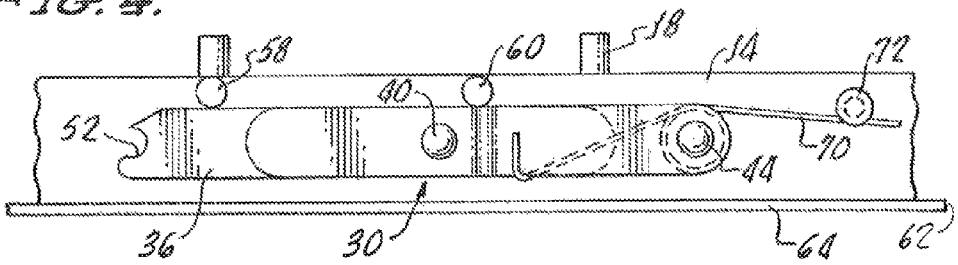
Figure 5:
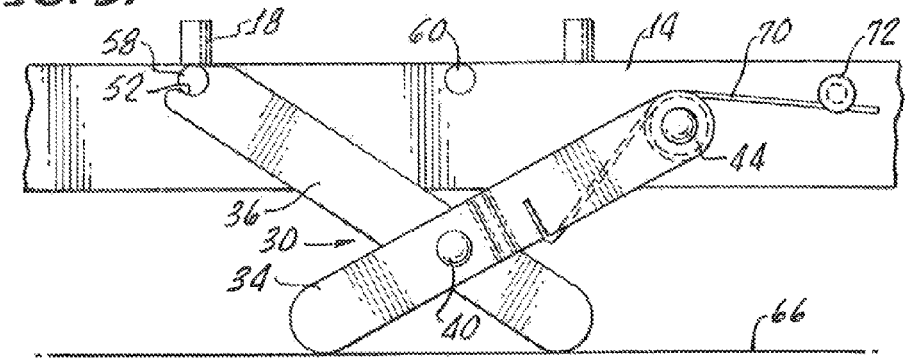
FIG. 5 is a peripheral side view illustrating partially extended legs.
Figure 6:
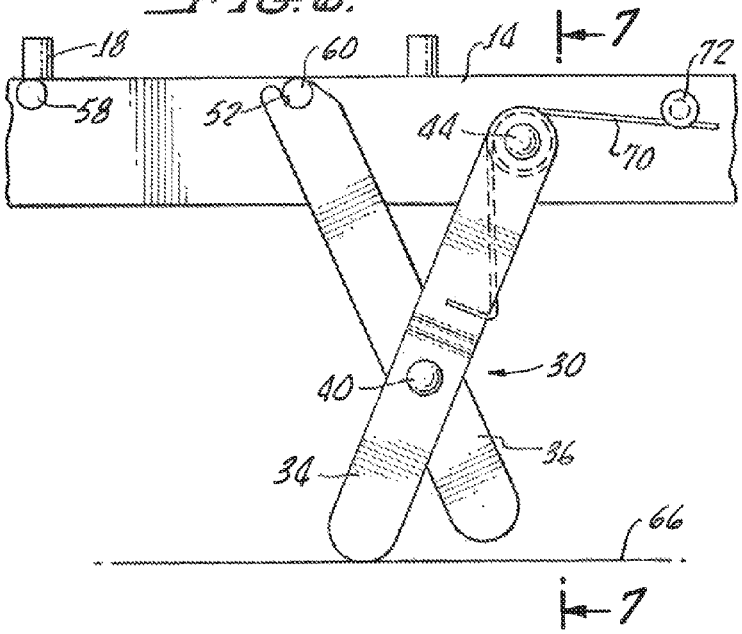
FIG. 6 is a partial side view showing fully extended legs.

As best illustrated in FIGS. 4-6, the legs 30 are foldable with a first leg element 34 pivotably mounted to a second leg element 36 by a pin 40.

The first leg element in turn is pivotably mounted to the rim 14 by a pin 44 while an end 48 of the second leg element includes a notch 52 for engaging one of several stops protruding laterally from the rim 14 in order to vary the elevation of the rim 14 above a top of baked goods 28.

Figure 7:
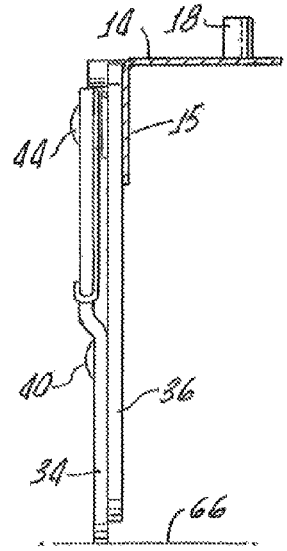
FIG. 7 is a cross sectional view taken along the line 7-7 of FIG. 6.

As shown in FIGS. 4-6, the legs 30 are foldable to a position enabling engagement of the rim 14 with a perimeter 62 of a cake pan 64. Extended legs shown in FIGS. 5-6 shows the rim 14 in various elevations above a surface 66 with the legs secured by engagement of the notch 52 with the stops 56, 58. It should be appreciated that any number of stops (not shown) may be utilized to provide for various extensions of the legs 30 and concomitantly various heights of elevation of the rim 14. As shown in FIG. 7, depending flange 15 for engaging a perimeter of a cake pan may depend from rim 14.

A spring 70, engaging the first leg element 34 and a pin 72, biases the legs 30 to the folded, or closed, position as shown in FIG. 4.

Although there has been hereinabove described a specific bakery cutting guide in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A bakery cutting guide comprising:

a rim configured for surrounding baked goods;

a plurality of spaced apart pins affixed to and extending upwardly from said rim, wherein four of said plurality of pins are disposed at corners of the rim and a remainder of said plurality of pins are evenly disposed between the rim corners;

a bar positionable for engaging pairs of opposing pins configured for guiding a knife or scorer across said baked goods in order to cut or mark said baked goods in a selected geometric pattern; and a plurality of legs comprising at least three legs extending downwardly from said rim configured for supporting said rim in an elevated position above a top of said baked goods;

wherein each leg of the plurality of legs comprises a first leg element only pivotably connected to the rim at one end and the first leg element at another end is also only pivotably connected to a second leg element, wherein the second leg element is configured to removably engage a feature on the rim, thereby forming the plurality of legs extending downwardly; and wherein each leg of the plurality of legs comprises a torsion spring, wherein each torsion spring is defined as having a spring center with a first spring extension opposite a second spring extension, where the spring center is pivotably coupled to the rim aligned with the pivotable connection of the one end of the first leg element, and wherein the first spring extension is configured to directly engage the rim and the second spring extension is configured to directly engage the first leg element, where the torsion spring biases the first leg element to pivot towards the rim.

2. The guide according to claim 1 wherein the legs are adjustable in order to vary the elevation of said rim.

3. The guide according to claim 2 wherein the legs are foldable.

4. The guide according to claim 3 wherein said rim is rectangular.

5. The guide according to claim 4 wherein said rim includes a depending flange for engaging a perimeter of a cake pan and the legs are foldable to a position enabling the engagement.

6. The guide according to claim 1, wherein the plurality of legs are configured to rest upon a surface, the surface also supporting the baked goods.

7. A bakery cutting guide comprising:

a rim configured for surrounding baked goods;

a plurality of spaced apart pins affixed to and extending upwardly from said rim, wherein four of said plurality of pins are disposed at corners of the rim and a remainder of said plurality of pins are evenly disposed between the rim corners;

a bar positionable for engaging pairs of opposing pins configured for guiding a knife or scorer across said baked goods in order to cut or mark said baked goods in a selected geometric pattern; and a plurality of legs comprising at least three legs extendable downwardly for said rim configured for supporting said rim in an elevated portion above a top of said baked goods;

wherein each leg of the plurality of legs comprises a first leg element only pivotably connected to the rim at one end and the second leg element at another end is also only pivotably connected to a second leg element, wherein the second leg element is configured to removably engage at least two different features on the rim, thereby forming the plurality of legs extending downwardly, and each leg of the plurality of legs comprising a torsion spring biased directly against the rim and the first leg element which biases the plurality of legs in a fixed position, where the torsion spring is not directly biased against the second leg element.

8. The guide according to claim 7 wherein the legs are adjustable in order to vary the elevation of said rim.

9. The guide according to claim 8 wherein the legs are foldable.

10. The guide according to claim 9 wherein said rim is rectangular.

11. The guide according to claim 9 wherein said rim includes a depending flange for engaging a perimeter of a cake pan and the legs are foldable to a position enabling the engagement.

12. The guide according to claim 7, wherein the plurality of legs are configured to rest upon a surface, the surface also supporting the baked goods.

13. A bakery cutting guide comprising:

a rim configured for surrounding baked goods;

a plurality of spaced apart pins affixed to and extending upwardly from said rim, wherein four of said plurality of pins are disposed at corners of the rim and a remainder of said plurality of pins are evenly disposed between the rim corners, the pins enabling a bar to be positioned for engaging pairs of opposing pins configured for guiding a knife or scorer across said baked goods in order to cut or mark said baked goods in a selected geometric pattern; and a plurality of legs comprising at least three legs extending downwardly from said rim configured for supporting said rim in an elevated position above a top of said baked goods, wherein each of the legs are foldable, and wherein each leg of the plurality of legs comprises a first leg element only pivotably connected to the rim at one end and the first leg element at another end is also only pivotably connected to a second leg element, wherein the second leg element is configured to removably engage a plurality of laterally extending pins connected to the rim, and each leg of the plurality legs comprising a torsion spring biased directly against the rim and the first leg element biasing the first leg element to pivot towards the rim which also then biases the plurality of legs in a fixed position.

14. The guide according to claim 13 wherein the legs are adjustable in order to vary the elevation of said rim.

15. The guide according to claim 13, wherein the plurality of legs are configured to rest upon a surface, the surface also supporting the baked goods.

16. The guide according to claim 13 wherein said rim is rectangular.

17. The guide according to claim 16 wherein said rim includes a depending flange for engaging a perimeter of a cake pan and the legs are foldable to a position enabling the engagement.

18. A bakery cutting guide comprising:

a rim configured for surrounding baked goods;

a plurality of spaced apart pins affixed to and extending upwardly from said rim, wherein four of said plurality of pins are disposed at corners of the rim and a remainder of said plurality of pins are evenly disposed between the rim corners;

a bar positionable for engaging pairs of opposing pins configured for guiding a cutting implement across said baked goods in order to cut or mark said baked goods in a selected geometric pattern; and a plurality of legs comprising at least three legs extending downwardly from said rim configured for supporting said rim in an elevated position above a top of said baked goods;

wherein each leg of the plurality of legs comprises a first leg element only pivotably connected to the rim at one end and the first leg element at another end is also only pivotably connected to a second leg element, wherein the second leg element is configured to removably engage a plurality of laterally extending pins connected to the rim, and each leg of the plurality of legs including a torsion spring biased directly against the rim and the first leg element which biases the first leg element to pivot towards the rim which then also biases the plurality of legs in a folded position or a raised position.

19. The guide according to claim 14, wherein the bakery cutting guide further comprises secondary pins in addition to said a plurality of spaced apart pins, said secondary pins having spacing therebetween that differs from the spacing of said plurality of spaced apart pins.

20. A bakery cutting guide comprising:

a rim configured for surrounding baked goods;

a plurality of spaced apart pins affixed to and extending upwardly from said rim, wherein four of said plurality of pins are disposed at corners of the rim and a remainder of said plurality of pins are evenly disposed between the rim corners, the pins enabling a bar to be positioned for engaging pairs of opposing pins configured for guiding a cutting implement across said baked goods in order to cut or mark said baked goods in a selected geometric pattern; and a plurality of legs comprising at least three legs extending downwardly from said rim configured for supporting said rim in an elevated position above a top of said baked goods, wherein each leg of the plurality of legs comprises a two leg element and a torsion spring, the two leg element comprising a first leg element only pivotably connected to the rim at one end and also the first leg element at another location is only pivotably connected to a second leg element, where the plurality of legs are foldable and each leg of the plurality of legs includes the torsion spring biased directly against the rim and biased against each of the first leg elements of the plurality of legs thereby biasing the plurality of legs in a folded position or a raised position.

* * * * *